United States Patent [19]

Westerbeke, Jr.

[11] Patent Number: 5,014,660

[45] Date of Patent: May 14, 1991

[54] COOLING SYSTEM FOR AN ENCLOSED HEAT SOURCE

[75] Inventor: John H. Westerbeke, Jr., Milton, Mass.

[73] Assignee: Westerbeke Corporation, Avon, Mass.

[21] Appl. No.: 605,529

[22] Filed: Oct. 29, 1990

[51] Int. Cl.[5] ..... F02B 77/00

[52] U.S. Cl. ..... 123/198 E; 123/2; 123/41.01; 181/202; 181/204; 440/113

[58] Field of Search ..... 123/41.31, 41.57, 2, 123/198 E, 41.01; 165/51; 290/1 R, 1 A, 1 B; 114/269, 270; 440/3, 6, 84, 88, 113, 900; 181/202, 204

[56] References Cited

U.S. PATENT DOCUMENTS

| | | | |
|---|---|---|---|
| 3,144,858 | 8/1964 | Horning et al. | 123/41.31 |
| 4,734,070 | 3/1988 | Mondek | 440/88 |
| 4,747,360 | 5/1988 | Tuncel et al. | 114/269 |
| 4,836,123 | 6/1989 | Grinde et al. | 114/270 |
| 4,924,826 | 5/1990 | Vinson | 123/198 E |

FOREIGN PATENT DOCUMENTS

| | | | |
|---|---|---|---|
| 3402772 | 8/1985 | Fed. Rep. of Germany | 123/198 E |

OTHER PUBLICATIONS

Westerbeke, *SoundGuard* Literature, 2/1990.

*Primary Examiner*—Noah P. Kamen

[57] ABSTRACT

A cooling system is provided for an enclosed heat source including an enclosure substantially enclosing the heat source. The heat source is positioned in the enclosure. A heat exchanger, also positioned within the enclosure, is connected through the enclosure to an external source of cooling fluid and is adapted for cooling air within the enclosure. Air circulation means are provided within the enclosure for circulating air past both the heat source and the heat exchanger. A method of cooling an air cooled heat source within an enclosure is also provided.

17 Claims, 1 Drawing Sheet

COOLING SYSTEM FOR AN ENCLOSED HEAT SOURCE

BACKGROUND OF THE INVENTION

The invention relates to cooling enclosed power generating heat sources, and more particularly to cooling engine driven generators (gensets), especially those utilized in marine vehicles.

Engine driven generator sets include an electrical generator powered by an auxiliary engine. Because of the inefficiencies of the processes, the machinery loses a significant portion of its output energy in the form of heat generation. This heat must be dissipated so that it does not result in a loss of efficiency or even danger to those present. Therefore, various forms of heat dissipation systems are utilized.

One common system of heat dissipation for heat producing machinery is to expose the machinery to the ambient air and utilize fans to both draw air into and to expel air from the machinery. Because ambient air is normally considerably cooler than the heat generating machinery it is cooling, the system results in satisfactory cooling. An alternate embodiment of this system is to employ a liquid cooled engine in which the engine includes a jacket through which water or other coolant is circulated to dissipate heat. The generator is air cooled as before. Significant noise is created by the machinery, and heat is dissipated by the machinery, even to a certain extent when jacketed and liquid cooled, and the noise and heat are output to the ambient surroundings. The noise and the dissipated heat restrict the possible locations for the system. Thus, it is normally objectionable to place the machinery near passengers in a vehicle.

SUMMARY OF THE INVENTION

In one aspect, the invention features a cooling system for a substantially enclosed power generating heat source. The heat source is positioned within an enclosure. A heat exchanger, also positioned within the enclosure, is connected through the enclosure to an external source of cooling fluid and is adapted for cooling air within the enclosure. Air circulation means are provided within the enclosure for circulating air past both the heat source and the heat exchanger.

Preferred embodiments of this aspect of the invention include air circulation means comprising at least one circulation fan, and cooling fluid circulating means comprising a pump. The heat source can include an air-cooled generator, a combination air-cooled engine-generator arrangement, or a combination water-cooled engine air-cooled generator arrangement. The enclosure includes an aperture to admit external combustion air into the enclosure to the engine's air intake. The air intake can be spaced from the aperture, in which case the aperture is minimally sized for the admission of combustion air, or the air intake can be directly connected to the aperture. When the cooling system is in a watercraft, the external source of cooling fluid is water external to the watercraft.

In another aspect, the invention features a method of cooling a power generating heat source in an enclosure. This method provides a heat exchanger within the enclosure adapted for cooling air therewithin. Cooling fluid obtained external to the enclosure is circulated through the heat exchanger, and air within the enclosure is circulated past both the heat exchanger and the heat source.

Thus, the invention provides a cooling system which can effectively cool heat generating machinery by utilizing an air-cooling process, or partial air-cooling process, in a substantially air tight enclosed space, and can thereby remove the dissipated heat within the enclosure while reducing a significant portion of the noise resulting from the operation of the machinery. It is thus possible to place an enclosed genset in convenient locations which would otherwise be objectionable, e.g., in proximity to passengers in a vehicle.

These and other objects, features and advantages of the invention will be seen from the following description of preferred embodiments, and from the accompanying drawings and claims.

DETAILED DESCRIPTION OF PREFERRED EMBODIMENTS

Generally, the system includes heat producing machinery contained within an enclosure. The enclosure serves to contain the heat dissipated by the machinery and to reduce noise levels emanating from components of the system to the environment. Therefore, the heat producing machinery can be placed anywhere on the vehicle without discomfort or danger to the passengers. However, because the excess heat contained within the enclosure can damage the machinery and could even result in dangerous situations, a heat exchanger is utilized within the enclosure to dissipate the heat.

Figure 1:
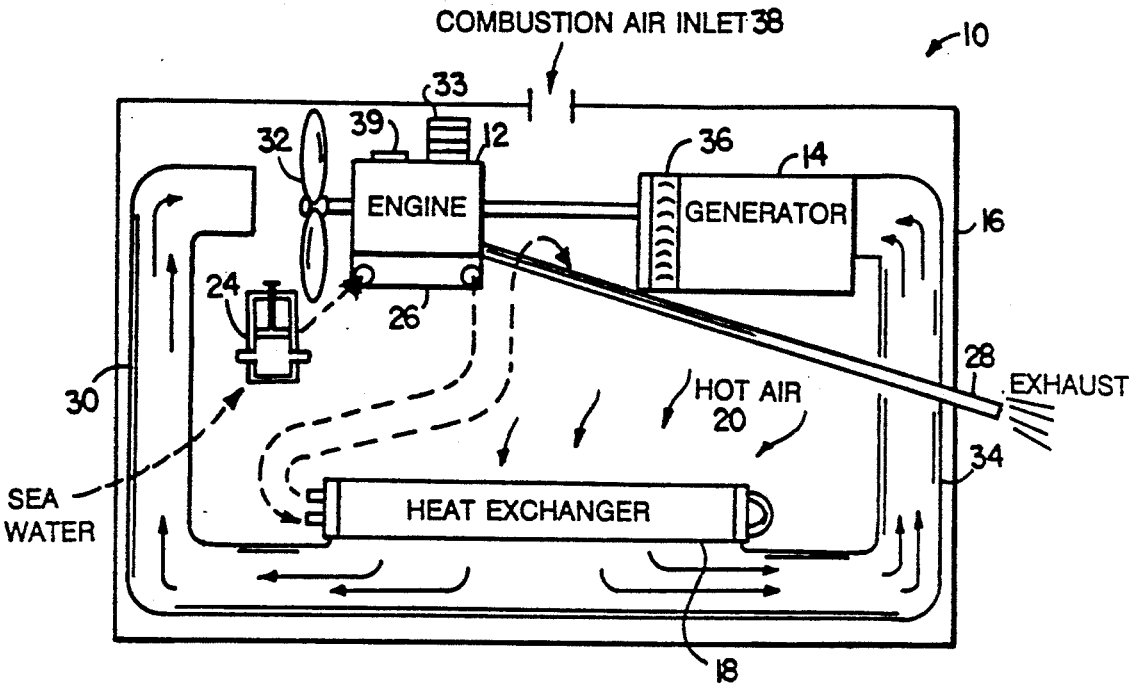
FIG. 1 is a diagrammatic illustration of one embodiment of the invention.

Referring now to FIG. 1, an engine driven generator set 10 is depicted which can be utilized in a boat. Both the engine 12 and the generator 14 in this embodiment are contained within a substantially airtight enclosure 16. This enclosure can be partially or fully lined with a sound absorbing material such as an open cell urethane foam, e.g., a laminate sold under the name Soundmat PB "M" by The Soundcoat Company, Inc., of Deer Park, N.Y., comprising two layers of foam laminated to an intermediate flexible vinyl layer and faced on the exposed side with a protective acrylic film. In this way, the genset can be placed in various locations about the boat, including areas containing passengers, without adding substantial heat and noise to the surroundings and hence, creating an uncomfortable environment.

The generator 14 is air cooled. The engine 12 may be air cooled or may be water cooled, utilizing a standard water cooled engine of the art, leaving only the generator to be air cooled. In this latter case, surface heat emanating from the engine is dissipated by the air cooling method described below.

A heat exchanger 18 is utilized to dissipate heat within the enclosure and includes a fluid side and an air side. Hot air 20 enters the heat exchanger and is cooled by a cool circulating fluid contained within the heat exchanger 18. The cool fluid is pumped into the heat exchanger from an outside source. When the genset is utilized in a marine vehicle, the external source may be the raw sea water surrounding the marine vehicle. Otherwise, recirculating water or other coolant is utilized as the source. When the hot air 20 contacts the cool fluid in the heat exchanger, thermal transfer occurs. Thus the air exits the heat exchanger as cooled air while the fluid exits the heat exchanger as warmed fluid.

In the illustrated embodiment, the heat exchanger 18 is arranged in series with both the engine and the generator, but cooling of these machines is accomplished in parallel. The fluid side of the cycle begins with an external fluid source. In the embodiment illustrated in FIG. 1, raw sea water is pumped via pump 24 into the enclosure and then into the fluid side of the heat exchanger. The aperture through which the conduit for the water passes is sealed about the conduit in an air tight manner. The water may pass through an oil cooler 26 utilized to lower the temperature of the oil contained in the engine. The water pump 24 is located within the enclosure 16 and is belt driven (not shown) from the engine. The raw water cools the hot air produced by the machinery. The warmed water is then pumped into the engine exhaust line 28 to lower the temperature of the outgoing exhaust and is discharged with the exhaust into the sea. Exhaust line 28 passes through enclosure 18 being sealed thereto in an air tight manner as is usual with marine exhausts passing through a hull. Alternatively, the raw sea water may be expelled separately from the exhaust.

The air side of the cycle is maintained as a closed circulating system. It begins with hot air produced by the machinery. This hot air 20 is directed into the heat exchanger 18, which cools the air. The air path then separates into two parallel paths. The first path passes through air duct 30 to cooling fan 32 to the engine. The fan 32 moves cooled air from heat exchanger 18 through duct 30 past the engine 12. In the case of an air cooled engine cooling fins 33 are provided past which the cooled air is moved. Engine heat is thus transferred to the cool air. The cycle is repeated as the hot air is directed back to the heat exchanger.

Similarly, the second air path is directed through air duct 34 to the generator 14. The cool air is pulled through the generator by integral centrifugal cooling fan 36 and acts to transfer the heat from the generator to the air. The hot air exits the generator and is again directed toward the heat exchanger. The cycle begins again.

The engine is powered by fuel combustion and therefore requires air for the process. In one embodiment, combustion air is obtained from the circulating air within the enclosure 18. A portion of the air in the enclosure is utilized during the combustion process and must be replenished. Toward this end, a minimally sized combustion air inlet 38 remote from the engine air intake is included in the enclosure, comprising a small aperture formed in the wall of the enclosure. Of course, the sizing of the aperture varies for different engines, but an example of appropriate sizing for a 300 cc engine would be approximately 2 cm. by 2 cm. Ambient air from outside of the enclosure enters the system through this aperture. The entering combustion air is cooled by mixing with the cooled air present in the enclosure. Flame arrestor material (not shown) may be placed across inlet aperture 38 both for safety and to dampen noise. Alternatively, a carburetor inlet 39 may contain flame arresting material. This method of air intake aids in preventing noise generated by the carburetor intake pipe from emanating to the outside of the enclosure. Except for air inlet 38, enclosure 18 is preferably substantially air tight to contain noise and heat.

Figure 2:
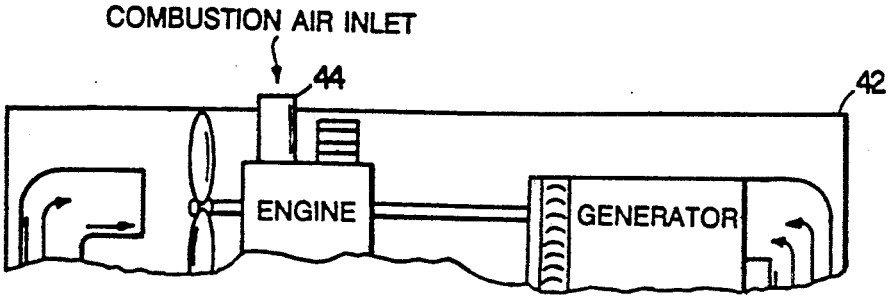
FIG. 2 is a fragmentary, diagrammatic illustration of the invention illustrated in FIG. 1 modified to have a different arrangement for the entry of combustion air to the engine.

An alternate embodiment of the invention is diagrammatically illustrated in FIG. 2. It includes identical equipment to the embodiment described in FIG. 1. However, a combustion air inlet pipe or tube 44 is provided through enclosure 42 wherein air is admitted from outside directly to the air intake carburetor (not shown) of the engine. The aperture in enclosure 42, through which the air inlet tube 44 passes, is sealed in an air tight manner about the inlet tube 44. Flame arrestor material (not shown) is placed across the opening of inlet pipe or tube 44 for safety and to dampen noise. Additionally, an exhaust pipe (not shown) passes through in the enclosure 42 in an air tight manner. Therefore, there are no apertures in the enclosure, which is maintained substantially airtight.

Thus, in accordance with both embodiments of the invention the engine is contained in a substantially air tight enclosed space. There is, however, no need to derate the power output from the generator merely because it is contained within a sound enclosure whose internal air temperature would usually be higher than specified for the rated generator output. Rather, the internal air temperature is controlled under a predetermined maximum temperature dependant upon the raw water temperature. This invention allows for broad control of the generator inlet air temperature by sizing of the heat exchanger and fluid flow.

While the preferred embodiments are described for illustrative purposes, one skilled in the art should recognize many modifications in structure, arrangement, portions, and components used in the practice of the invention and otherwise which are consistent with the principles of the broader appended claims of the invention.

What is claimed is:

1. A cooling system for an enclosed power generating heat source, comprising:

said heat source;

an enclosure substantially enclosing said heat source;

a heat exchanger positioned within said enclosure, said heat exchanger communicating through said enclosure for connection to an external source of cooling fluid and adapted for cooling air within said enclosure; and air circulation means within said enclosure adapted for circulating air from said heat exchanger past said heat source and said heat exchanger.

2. The cooling system claimed in claim 1 in which said heat source comprises an air cooled generator.

3. The cooling system claimed in claim 1 in which said air circulation means comprises at least one air circulation fan.

4. The cooling system claimed in claim 1 in which a pump is connected to said heat exchanger for circulating said cooling fluid therethrough.

5. The cooling system claimed in claim 4 in which said cooling system is in a watercraft and said external source of cooling fluid is water external to said watercraft and said heat exchanger is adapted for connection to said water.

6. The cooling system claimed in any one of claims 3, 4 or 5 in which said heat source comprises an air cooled generator.

7. The cooling system claimed in any on claims 1, 2, 3, 4, or 5 in which said heat source comprises an engine.

8. The cooling system claimed in claim 7 in which said enclosure includes an aperture to admit external combustion air into said enclosure; said engine has an air intake for combustion air, said air intake is spaced from said aperture and said aperture is minimally sized for the admission of combustion air.

9. The cooling system claimed in claim 7 in which said enclosure includes an aperture to admit air into said enclosure, said engine has an air intake for combustion air and said air intake is directly connected to said aperture.

10. The cooling system claimed in claim 7 in which said engine comprises an air cooled engine.

11. The cooling system claimed in claim 7 in which said engine comprises a liquid cooled engine.

12. A method of cooling a substantially enclosed power generating heat source in an enclosure, comprising:

providing a heat exchanger within said enclosure adapted for cooling air therewithin;

connecting said heat exchanger to a source of cooling fluid external to said enclosure;

circulating said cooling fluid obtained external to said enclosure through said heat exchanger; and circulating air within said enclosure past said heat exchanger and said heat source.

13. The method claimed in claim 12 in which said enclosure is in a watercraft, said external source of cooling fluid is seawater and said seawater is circulated to said heat exchanger by a pump within said enclosure.

14. The method claimed in either of claims 12 or 13 in which said heat source comprises an engine.

15. The method claimed in either of claims 12 or 13 in which said heat source comprises an air cooled generator.

16. The method claimed in claim 15 in which said heat source further comprises an air cooled engine.

17. The method claimed in claim 15 in which said heat source further comprises a liquid cooled engine.

* * * * *